US006619050B2

(12) United States Patent
Hozumi et al.

(10) Patent No.: US 6,619,050 B2
(45) Date of Patent: Sep. 16, 2003

(54) METHOD AND APPARATUS FOR SOLIDIFYING SUPERCOOLED WATER AS WELL AS METHOD AND SYSTEM FOR CIRCULATING OR FLOWING PARTIALLY FROZEN WATER

(75) Inventors: Tsutomu Hozumi, Machida (JP); Akio Saito, Yokohama (JP); Seiji Ohkawa, Yokohama (JP); Hiroyuki Kumano, Meguro-Ku (JP)

(73) Assignee: Tokyo Institute of Technology, Tokyo (JP)

( * ) Notice: Subject to any disclaimer, the term of this patent is extended or adjusted under 35 U.S.C. 154(b) by 0 days.

(21) Appl. No.: 10/118,233

(22) Filed: Apr. 9, 2002

(65) Prior Publication Data

US 2002/0194854 A1 Dec. 26, 2002

(30) Foreign Application Priority Data

Apr. 18, 2001 (JP) ..... 2001-119075

(51) Int. Cl.[7] ..... B01F 3/04; F25C 1/18
(52) U.S. Cl. ..... 62/70; 62/307
(58) Field of Search ..... 62/69, 70, 307, 62/308

(56) References Cited

U.S. PATENT DOCUMENTS 1,221,746 A * 4/1917 Kirkpatrick ..... 62/308
1,509,043 A * 9/1924 Kobash ..... 62/308
2,133,521 A * 10/1938 Wussow et al. ..... 62/67
4,217,762 A * 8/1980 Sakamoto et al. ..... 62/132
4,641,500 A * 2/1987 Hosokawa et al. ..... 62/70
5,076,069 A * 12/1991 Brown ..... 62/308
5,884,490 A * 3/1999 Whidden ..... 62/70

* cited by examiner

*Primary Examiner*—William E. Tapolcal
(74) *Attorney, Agent, or Firm*—Oliff & Berridge, PLC

(57) ABSTRACT

A method is disclosed for freezing supercooled water, which method includes the steps of (1-1) filling said supercooled water in a sealed container, reducing pressure of said supercooled water to generate bubbles from the supercooled water, mixing said generated bubbles in the supercooled water, or (1-2) filling said supercooled water in a sealed container with a bubble-mixing inlet, reducing pressure of the supercooled water to mix bubbles into the supercooled water from outside of the container through the bubble mixing inlet, or (1-3) filling said supercooled water in the sealed container with the bubble-mixing inlet, introducing bubbles into the supercooled water from outside the container through the bubble-mixing inlet under pressure, mixing the bubbles into the supercooled water, (2) simultaneously repeating expansion, compression, disruption, clustering and disappearance of the bubbles mixed into the supercooled water and (3) thereby freezing the supercooled water by vigorously oscillating gas-liquid boundaries between the bubbles and the supercooled water.

10 Claims, 6 Drawing Sheets

METHOD AND APPARATUS FOR SOLIDIFYING SUPERCOOLED WATER AS WELL AS METHOD AND SYSTEM FOR CIRCULATING OR FLOWING PARTIALLY FROZEN WATER

BACKGROUND OF THE INVENTION

1. Field of the Invention

The present invention relates to supercooled water-freezing method and apparatus which are used in an ice thermal storage system of a freezing machine, for example and adapted to release the supercooled water from a supercooled state through freezing. The invention also relates to a method and a system for circulating or flowing cooled water at least a part of which is released from a supercooled state. Particularly, the invention relates to the method and the apparatus for freezing supercooled water having a low supercooled degree, which method and apparatus can positively release the supercooled water from the supercooled state at an arbitrary point of time and at an arbitrary place. The invention also relates to the method and the system for circulating or flowing the supercooled water at least a part of which is released from the supercooled state.

2. Related Art Statement

A method in which flowing supercooled water is made to spontaneously fall and impinge upon a plate to freeze it is known as a conventional supercooled state-removing (freezing) technique.

However, since this method requires a sufficient long distance for freezing, an apparatus for this becomes bulky. Further, the supercooled water cannot be frozen at any time or any place. In addition, if the supercooled water is at a low supercooled degree, it is unfavorably difficult to freeze the water.

The present invention is aimed at solving the problems of the prior art apparatuses through discovery of the new supercooled state-removing method and apparatus having a smaller size than the conventional ones and being able to positively release the supercooled water from the supercooled state at any time and any place and rapidly freeze the supercooled water, even if the supercooled water is at such a low supercooled degree as not allowing easy freezing.

SUMMARY OF THE INVENTION

A first aspect of the present invention relates to a method for freezing supercooled water comprising the steps of (1-1) filling said supercooled water in a sealed container, reducing pressure of said supercooled water to generate bubbles from the supercooled water, mixing said generated bubbles in the supercooled water, or (1-2) filling said supercooled water in a sealed container with a bubble-mixing inlet, reducing pressure of the supercooled water to mix bubbles into the supercooled water from outside of the container through the bubble mixing inlet, or (1-3) filling said supercooled water in the sealed container with the bubble-mixing inlet, introducing bubbles into the supercooled water from outside the container through the bubble-mixing inlet under pressure, mixing the bubbles into the supercooled water, (2) simultaneously repeating expansion, compression, disruption, clustering and disappearance of the bubbles mixed into the supercooled water and (3) thereby freezing the supercooled water by vigorously oscillating gas-liquid boundaries between the bubbles and the supercooled water.

A second aspect of the present invention relates to an apparatus for producing frozen water from supercooled water, comprising (a) a sealed container with a supercooled water-filling opening or a sealed container with a supercooled water-filling opening and a bubble-mixing inlet for sealingly filling said supercooled water therein, (b) a charger for filling the supercooled water into the sealed container, (c) a bubble mixer for mixing bubbles into the supercooled water filled in the sealed container by (c-1) reducing pressure of said supercooled water inside the container to generate bubbles from the supercooled water and mixing said generated bubbles in the supercooled water, or (c-2) reducing pressure of the supercooled water filled in said container with the bubble-mixing inlet to mix bubbles into the supercooled water from outside of the container through the bubble mixing inlet, or (c-3) introducing bubbles into the supercooled water filled in the container from outside the container through the bubble-mixing inlet under pressure to mix the bubbles into the supercooled water, wherein while the bubble mixer mixes the bubbles into the supercooled water, expansion, compression, disruption, clustering and disappearance of the bubbles are simultaneously repeated, and gas-liquid boundaries between the bubbles and the supercooled water are vigorously oscillated to produce the frozen water from the supercooled water.

In the second aspect of the present invention, it is preferable that said sealed supercooled water container is a supercooled water cylinder, said supercooled water charger is a supercooled water piston gas-tightly, liquid-tightly and slidably fitted into the supercooled water cylinder, said supercooled water piston also serves as the bubble mixer, and the bubbles are mixed into the supercooled water inside the sealed supercooled water container by reducing pressure of the supercooled water through operating the supercooled water piston.

Further, in the second aspect of the present invention, it is preferable that said bubble mixer comprises a gas cylinder and a gas piston gas-tightly and slidably fitted into said gas cylinder, the gas cylinder and the sealed supercooled water container are connected to each other through the bubble-mixing inlet, the bubbles are introduced into the supercooled water in said container under pressure through the bubble-mixing inlet by operating the gas piston.

A third aspect of the present invention relates to a method for circulating or flowing supercooled water, comprising the steps of (1-1) taking at least a part of circulating or flowing supercooled water into a sealed container with a supercooled water-filling opening, reducing pressure of said supercooled water filled in the container to generate bubbles from the supercooled water, mixing said generated bubbles in the supercooled water, or (1-2) taking at least a part of circulating or flowing supercooled water into a sealed container with a supercooled water-filling opening and a bubble-mixing inlet, reducing pressure of the supercooled water filled in the container to mix bubbles into the supercooled water from outside of the container through the bubble mixing inlet, or (1-3) taking at least a part of circulating or flowing supercooled water into a sealed container with a supercooled water-filling opening and a bubble-mixing inlet, introducing bubbles from outside the container through the bubble-mixing inlet under pressure to mix the bubbles into the supercooled water, (2) simultaneously repeating expansion, compression, disruption, clustering and disappearance of the bubbles mixed into the supercooled water, (3) thereby freezing the supercooled water by vigorously oscillating gas-liquid boundaries between the bubbles and the supercooled water, and (4) returning the supercooled water at least a part of which is released from being supercooled into the circulating or flowing supercooled water.

A fourth aspect of the present invention relates to a supercooled water-circulating or flowing system, comprising (a) means for circulating or flowing supercooled water, (b) a sealed container provided with a supercooled water-filling opening or a sealed container provided with a supercooled water-filling opening and a bubble-mixing inlet, said container being adapted for sealingly receiving the supercooled water, (c) a charger for filling at least a part of the circulating or flowing supercooled water into the sealed container, (d) a bubble mixer for mixing bubbles into the supercooled water in the sealed container by (d-1) reducing pressure of said supercooled water filled in the container to generate bubbles from the supercooled water, and mixing said generated bubbles in the supercooled water, or (d-2) reducing pressure of the supercooled water filled in the container to mix bubbles into the supercooled water from outside of the container through the bubble-mixing inlet, or (d-3) introducing bubbles into the supercooled water filled in the container from outside the container through the bubble-mixing inlet under pressure to mix the bubbles into the supercooled water, wherein while the bubble mixer mixes the bubbles into the supercooled water, expansion, compression, disruption, clustering and disappearance of the bubbles are simultaneously repeated, gas-liquid boundaries between the bubbles and the supercooled water are vigorously oscillated to produce frozen water from the supercooled water, and a part of the frozen supercooled water is returned to the circulating or flowing supercooled water.

According to the present invention, while (1-1) said supercooled water is filled in a sealed container, pressure of said supercooled water is reduced to generate bubbles from the supercooled water, said generated bubbles are mixed in the supercooled water, or (1-2) said supercooled water is filled in a sealed container with a bubble-mixing inlet, pressure of the supercooled water is reduced to mix bubbles into the supercooled water from outside of the container through the bubble mixing inlet, or (1-3) said supercooled water is filled in the sealed container with the bubble-mixing inlet, bubbles are introduced into the supercooled water filled in the container from outside the container through the bubble-mixing inlet under pressure, the bubbles are mixed into the supercooled water, (2) simultaneously expansion, compression, disruption, clustering and disappearance of the bubbles mixed into the supercooled water are repeated and (3) thereby a part of the supercooled water is frozen and ice nuclei are formed by vigorously oscillating gas-liquid boundaries between the bubbles and the supercooled water. Consequently, the supercooled water can be frozen in the sealed container. When the water which is released from the supercooled state is discharged into the supercooled water outside the container, water in the surrounding area can be continuously frozen. The supercooled water inside the container is converted to a sherbet-like state after being released from the supercooled state.

Therefore, according to the freezing apparatus of the present invention, the supercooled water at such a low supercooled state as not allowing easy freezing can be instantly frozen at any time through positively eliminating the supercooled state with the smaller apparatus as compared with the prior art. In addition, since a number of such downsized apparatuses can be easily installed in the supercooled water or moved therein, the supercooled water can be frozen at any place.

Therefore, when the freezing apparatus according to the present invention is used as a supercooled state-eliminating apparatus for an ice thermal storage system, for example, the freezing load of the freezer can be largely reduced, which can greatly contribute to the energy storage field, the freezing air conditioning field and the environmental field.

In the present invention, since the sealed container is provided with the supercooled water inlet and the supercooled water outlet which can be opened and closed, the supercooled water inlet and the bubble-mixing inlet and the water outlet are controlled to be opened or closed in connection with the steps of filling the supercooled water into the container and the expansion, compression, disruption, clustering and disappearance of the bubbles, the supercooled water can be continuously frozen and discharged. In this case, one opening may be commonly used for two kinds of the supercooled water inlet and the supercooled water outlet. As the mixer for mixing the bubbles into the supercooled water in the container from outside of the container, means for reducing pressure in the container is used. For example, the sealed supercooled water container is a supercooled water cylinder, said supercooled water charger is a supercooled water piston gas-tightly, liquid-tightly and slidably fitted into the supercooled water cylinder, said supercooled water piston also serves as the bubble mixer, and the bubbles are mixed into the supercooled water inside the sealed supercooled water container by reducing pressure of the supercooled water through operating the supercooled water piston.

Further, said bubble mixer comprises a gas cylinder and a gas piston gas-tightly and slidably fitted into said gas cylinder, the gas cylinder and the sealed supercooled water container are connected to each other through the gas-mixing inlet, and the bubbles are introduced into the supercooled water in said container under pressure through the bubble-mixing inlet by operating the gas piston. Alternatively, a gas-feeding pump is provided as the gas mixer, so that the bubbles can be mixed into the supercooled water inside the supercooled water container through the bubble-mixing inlet by operating the gas feeding pump.

Furthermore, according to the present invention, a heater may be provided around the supercooled water-receiving container. According to such a freezing apparatus, when the cylinder is heated with the heater as the water released from the supercooled state through mixing between the bubbles and the water is discharged outside the cylinder, attachment of ice nuclei upon the inner wall of the cylinder can be prevented without excess heating of the supercooled water around the cylinder. This can facilitate the continuous use of the apparatus.

BRIEF DESCRIPTION OF THE DRAWINGS

In order to explain the invention, reference is made to the attached drawings, wherein.

DETAILED DESCRIPTION OF THE INVENTION

The present invention will be explained based on specific embodiments with reference to the drawings. The following embodiments are merely illustrated exclusively for merely explaining the invention, but it should not be interpreted that the invention is limited to only the embodiments illustrated.

Figure 1:
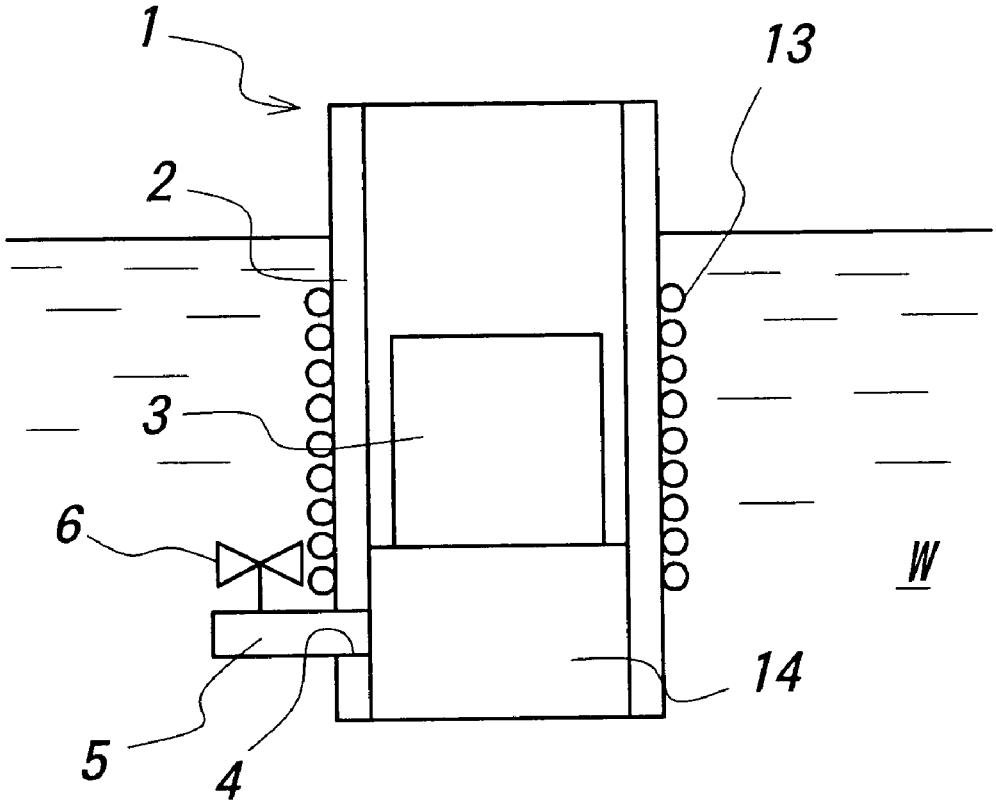
FIG. 1 is a sectional view of an embodiment of the supercooled water-freezing apparatus according to the present invention which is immersed in supercooled water.

FIG. 1 is sectional view of schematically illustrating one embodiment of the supercooled water-freezing apparatus according to the present invention, showing a state that a great part of the apparatus is immersed in supercooled water W circulating or flowing through a circulating channel or flow channel (not shown). The supercooled water-freezing apparatus of this embodiment comprises a receipt cylinder unit 1 as a container for sealingly receiving the supercooled water. The cylinder unit 1 comprises a cylinder 2 having a bottom portion closed, and a piston 3 gas-tightly, liquid-tightly and slidably fitted in the cylinder. A water inlet/outlet 4 is provided at a peripheral face of the supercooled water cylinder 2, and a supercooled water inlet/outlet pipe 5 is attached to the supercooled water inlet/outlet opening 4. The supercooled water inlet/outlet pipe 5 is opened or closed with a valve 6.

The cylinder 2 has an inner space with a uniform sectional shape and a uniform sectional area of a cross sectional face thereof (a plane extending right and left orthogonal to the paper in FIG. 1). The cylinder is not limited to a straight pipe or a round pipe. A piston 3 is liquid-tightly (gas-tightly) fitted in the cylinder 1 via an appropriate sealant (not shown) such that a supercooled water space 14 may be formed between the piston and the bottom of the cylinder. The cylinder unit 1 is provided with a piston driver (not shown) constituted by an electromagnetic solenoid or the like provided at an end portion of the cylinder 2, for example, so that the piston 3 is moved to-and-fro inside the cylinder 2.

Figure 2:
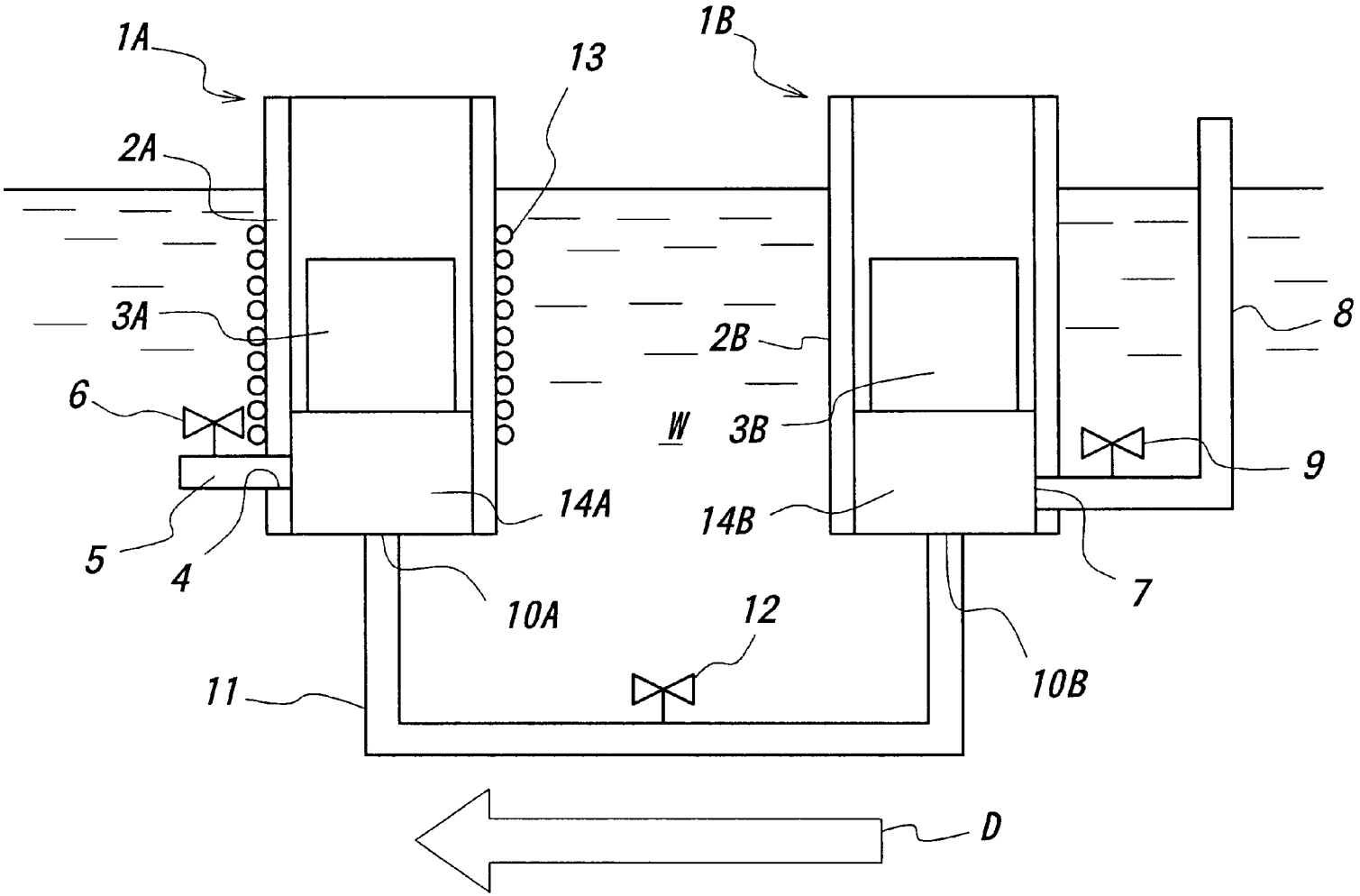
FIG. 2 is a sectional view of another embodiment of the supercooled water-freezing apparatus according to the present invention which is immersed in supercooled water.
Figure 3:
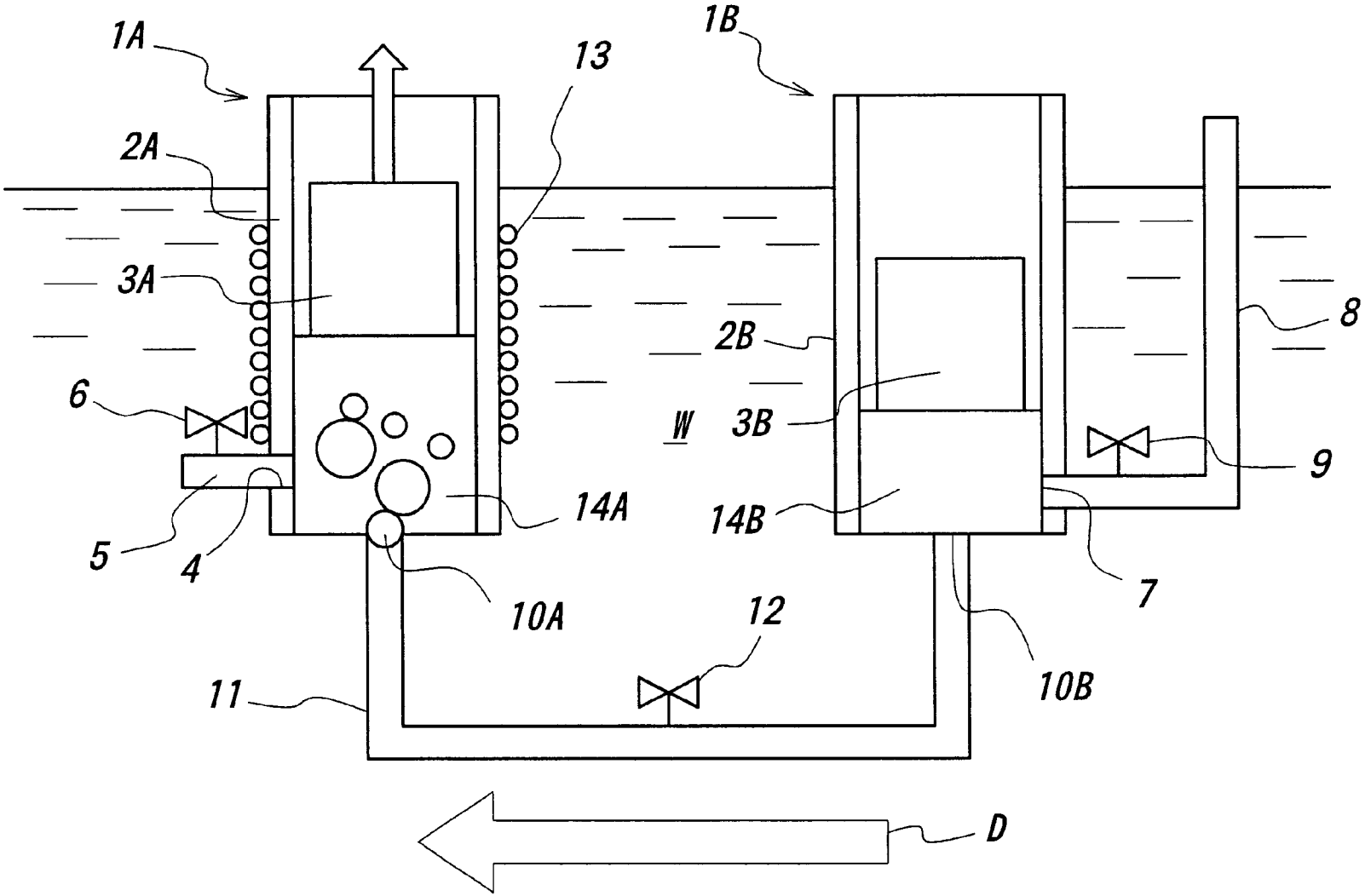
FIG. 3 is a figure for illustrating a step of mixing bubbles into the supercooled water by using the freezing apparatus in FIG. 2.
Figure 4:
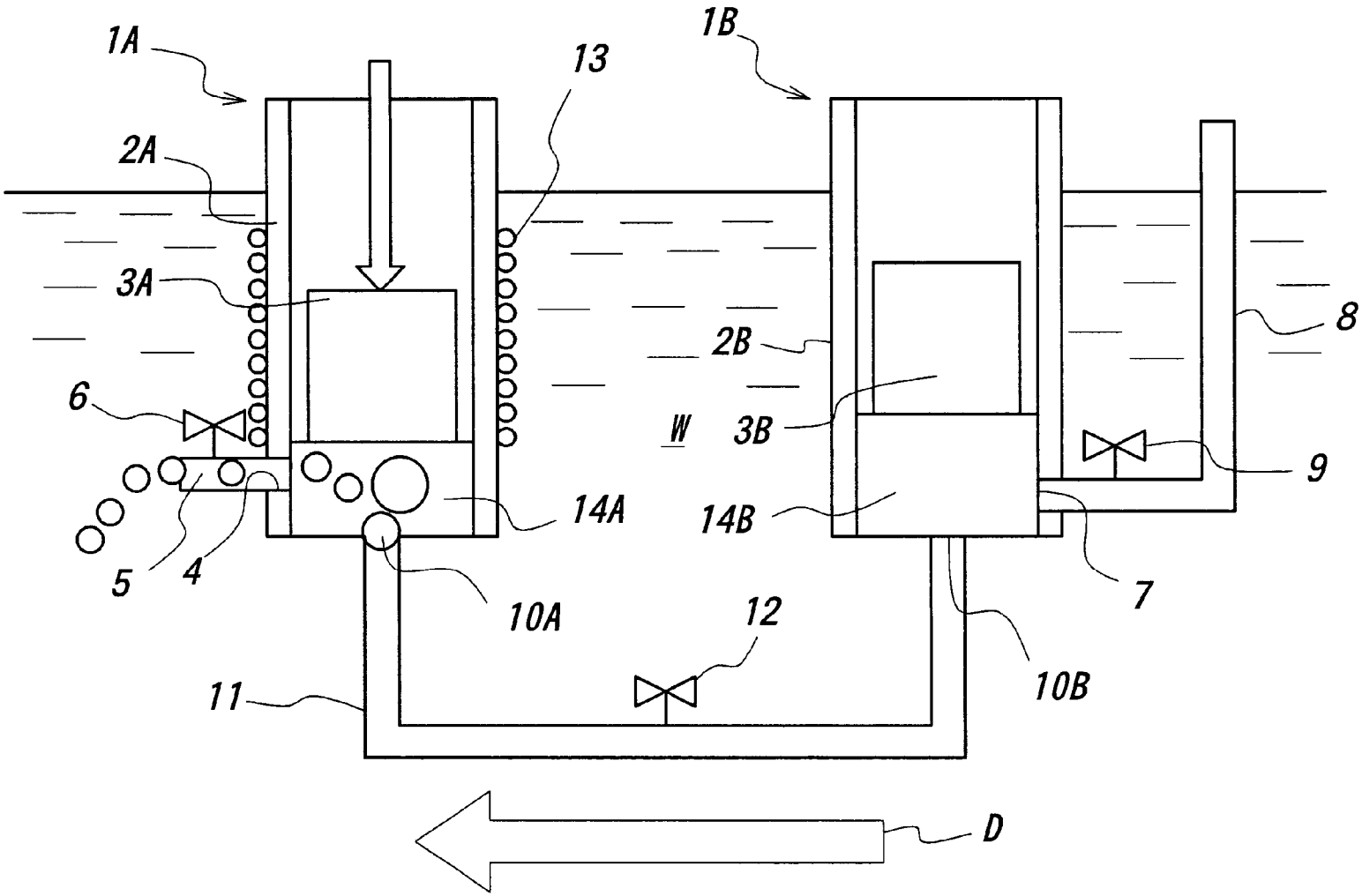
FIG. 4 is a figure for illustrating a step of forming ice nuclei in the supercooled water by using the freezing apparatus in FIG. 2.

FIG. 2 is a sectional view of schematically illustrating another embodiment of the supercooled water-freezing apparatus according to the present invention, showing a state that a main part of the apparatus is immersed in supercooled water W circulating or flowing through a circulating channel or flow channel (not shown). FIG. 3 is a sectional view for schematically illustrating a state in which bubbles are mixed in the supercooled water and ice nuclei are formed in the freezing apparatus of FIG. 2. FIG. 4 is a sectional view of schematically showing a state in which the supercooled water released from the supercooled state in the freezing apparatus of FIG. 2 is discharged to supercooled water outside the apparatus.

The supercooled water-freezing apparatus of this embodiment comprises a supercooled water-receiving cylinder unit 1A and gas cylinder unit 1B for feeding bubbles (such as air bubbles) into the cylinder unit 1A. Each of the cylinder units 1A and 1B comprises a cylinder 2A, 2B, and a piston 3A, 3B gas-tightly, liquid-tightly and slidably fitted into the cylinder. A water inlet/outlet 4 is provided at a peripheral face of the supercooled water cylinder 2A. A supercooled water inlet/outlet pipe 5 is attached to the water inlet/outlet opening 4, and the supercooled water inlet/outlet pipe 5 is opened or closed by a valve 6. On the other hand, a gas inlet/outlet opening 7 is provided at a peripheral face of the gas cylinder 2B. To the gas inlet/outlet pipe 7 is attached a gas inlet/outlet pipe 8 extending above the surface of the circulating or flowing supercooled water. The gas inlet/outlet pipe is opened or closed with a valve 9.

The cylinders 2A and 2B are provided at their bottoms with connecting openings 10A and 10B, respectively, and these openings are connected to gas inlet tube 11. In FIG. 2, a reference numeral 12 is an on/off valve provided in the gas inlet tube 11 for communicating the cylinder 2A and 2B or making interruption between them. A coil-type electric heater 13 is wound around the outer periphery of the supercooled water cylinder. If necessary, a supercooled water-flowing control orifice and a gas inflow control orifice (not show) may be provided at the supercooled water inlet/outlet 4, the connecting openings 10A, 10B and the gas inlet 7.

Each of the cylinders 2A and 2B has an inner space with a uniform sectional shape and a uniform sectional area of a cross sectional face thereof (a plane extending right and left orthogonal to the paper in FIG. 1). The cylinder is not limited to a straight pipe or a round pipe. A piston 3A (3B) is liquid-tightly (gas-tightly) fitted in the cylinder 2A (2B) via an appropriate sealant (not shown) such that a supercooled water space 14A (a gas space 14B) may be formed between the pistons 3A (3B) and the bottom of the cylinder 2A(2B), respectively. The cylinder units 1A and 1B are provided with piston drivers (not shown) constituted by electromagnetic solenoids or the like provided at end portions of the cylinders 2A and 2B, for example, respectively, so that the pistons 3A and 3B independently moved to-and-fro inside the cylinders 2A and 2B, respectively.

In the following, the function of the freezing apparatus according to this embodiments will be explained with reference to FIGS. 1 to 4. In these embodiment, the freezing apparatus is used in the state that each of them is immersed in the supercooled water W flowing in a constant direction inside a supercooled water-circulating means or flowing means (such as flow channels, not shown). In these figures, symbols W and D denote the supercooled water and the flow direction of the supercooled water W, respectively. The following explanation is made with reference to a case where the supercooled water is flown to make freezing more difficult. Needless to say, the apparatus according to the present invention does not require that the supercooled water flows, and the apparatus can be used in the supercooled water kept still.

The freezing apparatus according to the embodiment of FIG. 1 will be operated in the following order.

The valve 6 is opened, the piston 3 is upwardly slid by the piston driver (not show), and the circulating or flowing supercooled water is filled in the supercooled water space 14 of the cylinder 2 through the supercooled water inlet/outlet pipe 5. Next, the valve 6 is closed, the piston is further moved upwardly, and thereby the pressure inside the supercooled water space 14 in the cylinder 2, in other words, the pressure of the supercooled water inside that space 14 is reduced to generate bubbles in the supercooled water. After the piston 3 reaches its movable upper limit, it is moved down to its original position, and then moved upwardly again. The supercooled state is released by continuously effecting the above operation upon necessity, so that ice nuclei are formed in the supercooled water inside the cylinder 3. Controlling may be effected such that the piston 3 is moved downwardly due to negative pressure to give vibration upon the supercooled water in the state that the piston driver is stopped, the piston is made free from the piston driver, and the piston is moved upwardly again by the piston driver. In this case, when the piston driver for the piston 3 is stopped, the piston is instantly released from the above tensile force upon the piston. At that time, push force may be additionally applied to the piston 3 from the piston driver. The other operations will be explained in connection with the operation of the second embodiment of FIG. 2, and therefore are omitted here.

Operations of the freezing apparatus according to the second embodiment shown in FIGS. 2 to 4 will be explained.

(1) The valve 6 is opened, the valve 12 is closed, the piston 3A is upwardly slid by the piston driver (not show), and the circulating or flowing supercooled water is filled in the supercooled water space 14A of the cylinder 2A through the supercooled water inlet/outlet pipe 5 (See FIG. 2).

(2) On the other hand, the valve 9 is opened, the piston 3B is upwardly slid by the piston driver (not show), and a gas such as air is filled in the gas space 14B of the cylinder 2B through the gas inlet/outlet pipe 8 (See FIG. 2).

(3) Next, after the valves 6 and 9 are closed and the valve 12 is opened, the piston 3A is further moved upwardly. Thereby, the pressure of the supercooled water space 14A of the cylinder 2A, in other words, the pressure of the supercooled water inside that space 14A is reduced to mix the gas inside the gas space 14B of the cylinder 2B into the supercooled water through the gas inlet pipe 11. See FIG. 3. In the above case, it may be that a part of the supercooled water is moved into the gas inlet pipe 11 and the cylinder 2B to contact the supercooled water with the gas in the tube 11 and the cylinder 2B.

(4) After the piston 3A reaches its movable upper limit, it is moved down to its original position, and then moved upwardly again. While the bubbles are being mixed into the supercooled water by continuously effecting the above operations, the expansion, compression, disruption, clustering and disappearance of the bubbles are repeated, and thereby gas-liquid boundaries between the bubbles and the supercooled water are vigorously oscillated to release the supercooled water from the supercooled state and form ice nuclei in the supercooled water inside the cylinder 3A.

Controlling may be additionally effected such that the piston 3A is moved downwardly due to negative pressure to give vibration upon the supercooled water in the state that the piston driver is stopped, the piston is made free from the piston driver and the piston is moved upwardly again by the piston driver. In this case, when the piston driver for the piston 3A is stopped, the piston is instantly released from the above tensile force upon the piston. At that time, push force may be additionally applied to the piston 3A from the piston driver.

By the above construction, the piston 3A is urged in a forward (compression) direction toward the supercooled water inside the supercooled water-filled space 14A of the cylinder 2A owing to repulsion against the above tensile force and additionally the above push force. Consequently, the piston moves downwardly and forward at a high speed, so that it vigorously impinges upon boundary of the supercooled water W inside the supercooled water-filled space 14A to apply impact forces upon the supercooled water W. The ice nuclei are formed by the expansion, compression, disruption, clustering and disappearance of the bubbles as mentioned above. Further, the impact forces propagate in the supercooled water inside the supercooled water-filled space, which contributes to the removal of the supercooled state of the supercooled water W and the formation of the ice nuclei.

(5) Finally, the valve 6 is opened, the piston 3A is downwardly slid by the piston driver, and the water which is present inside the supercooled water space 14A and of which the supercooled state is removed is discharged into the circulating or flowing supercooled water through the supercooled water inlet/outlet pipe 5. See FIG. 4. The water containing the ice nuclei as discharged freezes the supercooled water outside the apparatus in a chain-like matter.

In the above steps (1) to (4), the coil type electric heater is turned off. At that time, a part of the supercooled water moves into the gas inlet pipe 11 and the cylinder 2B, the gas piston 3B is moved downwardly to discharge the supercooled water from the tube 11 and the cylinder 3B.

In the step (5) after the termination of the steps (1) to (4), the heater 13 is turned on upon necessity to remove an icy layer formed on the inner wall of the cylinder.

(6) By repeating the above steps (1) to (5), the supercooled water is continuously taken into the cylinder, and the water of which the supercooled state is removed can be discharged into the circulating or flowing supercooled water.

In the above embodiment, the gas is introduced into the supercooled water by operating the supercooled water piston 3A. But, the gas can be introduced into the supercooled water inside the supercooled water space 14A under pressure by operating the gas piston 3B without positively moving the supercooled water piston 3A.

Therefore, according to the freezing apparatus of this embodiment, the supercooled state can be positively eliminated with respect to the supercooled water having a lower supercooled degree at any time with the apparatus having a smaller size as compared with the prior art. In addition, since the freezing apparatus can be made in the smaller size, a number of such apparatuses can be easily installed or moved in the supercooled water. Thus, the supercooled water at any place can be frozen. Accordingly, if the freezing apparatus of this embodiment is used in a supercooled state-eliminating apparatus of an ice thermal storage system, for example, the freezing load of the freezer can be greatly reduced, which can largely contribute to the energy storage field, the freezing air conditioning field and the environmental field.

In addition, according to the freezing apparatus in this embodiment, since the heater 13 is provided around the periphery of the supercooled water cylinder 2A, any ice nuclei can be prevented from being attached to the inner wall of the cylinder without excessively heating the supercooled water in the surrounding area of the cylinder 2A, if the cylinder 2A is heated with the heater when the water of which the supercooled state is removed is discharged outside the cylinder 2A. This enables continuously easy use of the apparatus.

Figure 5:
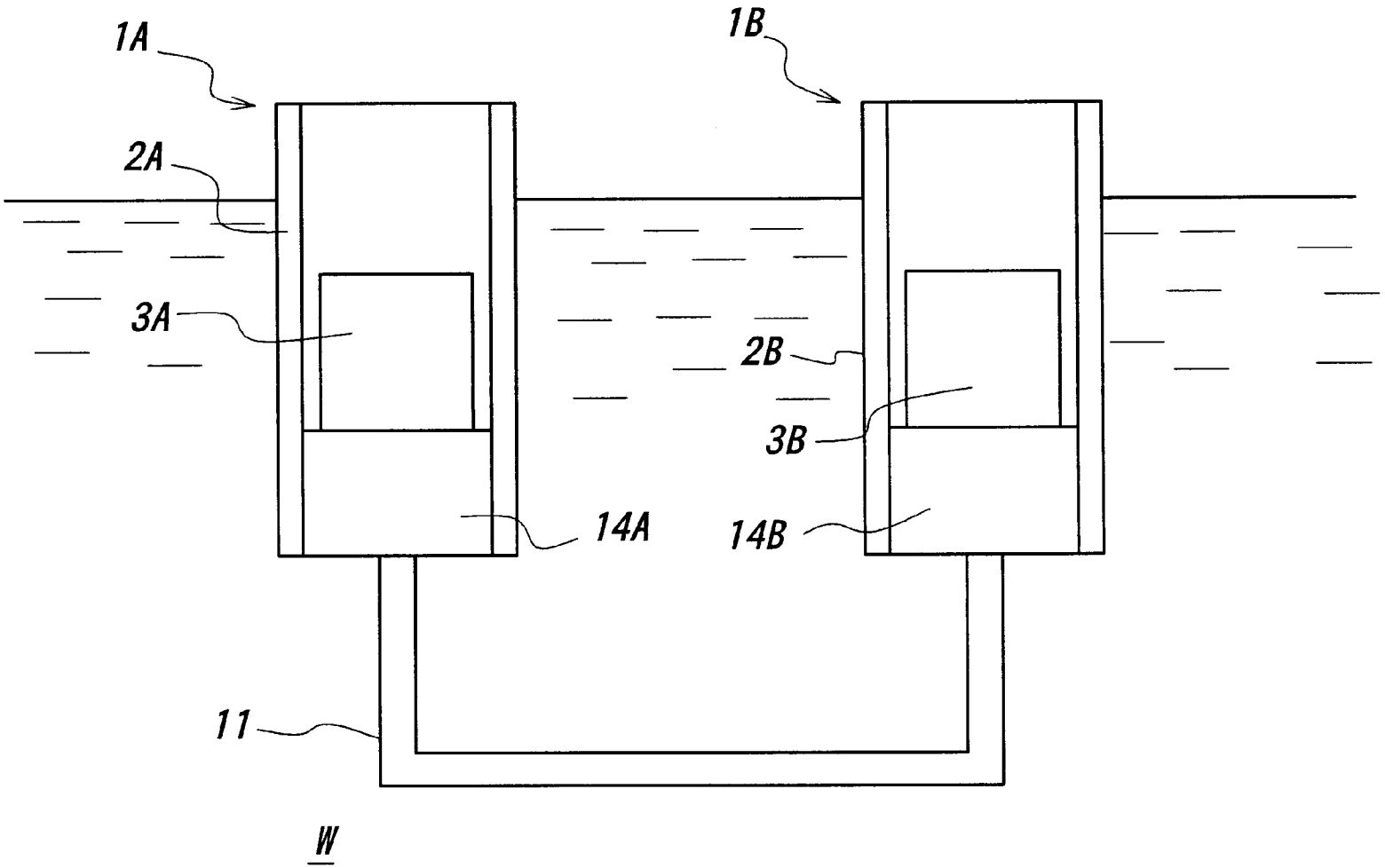
FIG. 5 is a sectional side view of a tester for examining effects of the freezing apparatus according to the present invention

FIG. 5 is an illustrative view of illustrating the tester for confirming the operation of the freezing apparatus according to the present invention. The present inventors conduct preliminary experiments on the above freezing of the supercooled water with use of this tester, and obtained the confirmation that the apparatus was effective.

The tester shown in FIG. 5 used two cylinders 2A and 2B made of polypropylene. The cylinders 2A and 2B had their holes at lower portions, and were connected with a tube 11 via the holes. The cylinders had pistons 3A and 3B liquid-tightly and gas-tightly fitted therein, respectively. Into the cylinder 2A was poured 5 $cm^3$ pure water, and air was sealed in the tube 11 and the cylinder 2B. By using the tester, a sample was cooled, and the entire tester was kept at a constant temperature slightly lower than 0° C. thereby realizing a supercooled state.

The piston 3A was moved upwardly, and bubbles were introduced into the supercooled water inside the cylinder 2A through the bottom hole. At that time, while the bubbles were being mixed into the supercooled water, they were subjected to various changes through expansion, compression, disruption, combination and extinction, thereby vigorously oscillating the gas-liquid boundaries and rising up in the supercooled water.

Figure 6:
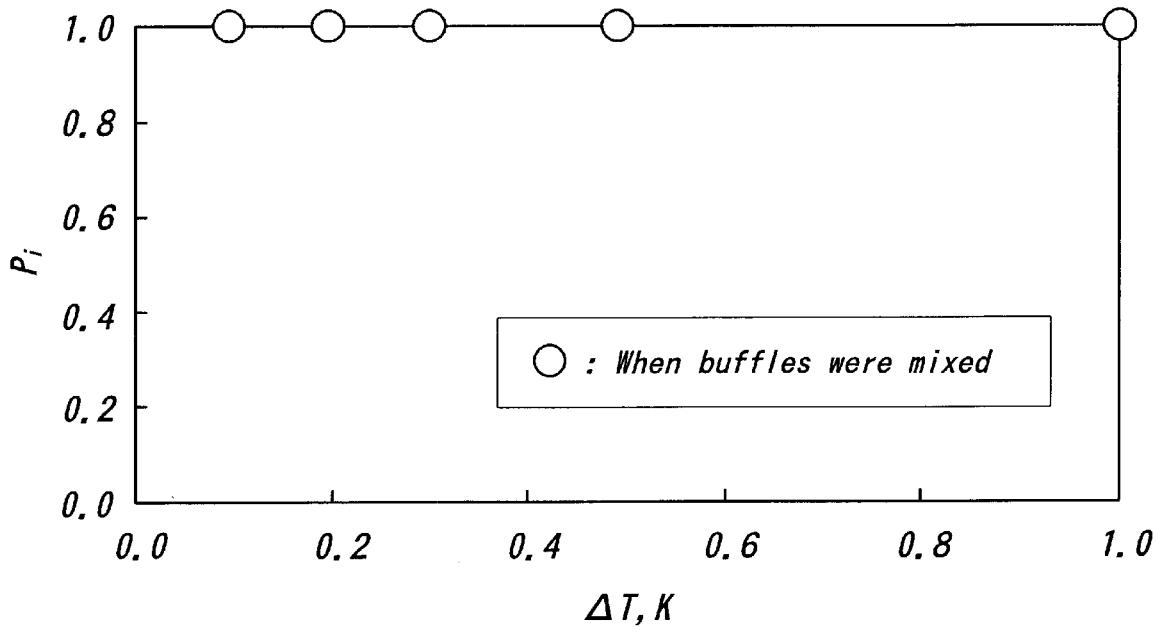
FIG. 6 is a graph showing experimental results when using a tester shown in FIG. 5.

FIG. 6 shows the relationship between absolute figures (supercooled degrees) ΔT of differences of supercooled water-freezing temperatures from 0° C. and probabilities of freezing. FIG. 6 gives freezing probabilities Pi when the supercooled water was kept at supercooled degrees ΔT of 0.1 K, 0.2 K, 0.3 K, 0.4 K, 0.5 K and 1.0 K. It is seen that freezing occurred at 100% at every temperature. The freezing probability refers to "(number of freezings in test)/(number of actual trials)×100(%). On the other hand, the average ΔT in case of no bubbles mixed was not less than about 15 K. From the above, it is considered that the formation of the nuclei was caused when while the bubbles were being mixed into the supercooled water, they were subjected to various changes through expansion, compression, disruption, combination and extinction, thereby vigorously oscillating the gas-liquid boundaries.

In the above, the present invention has been explained based on the embodiments illustrated. However, the invention is not limited to the above-mentioned embodiments. For example, although two kinds of the cylinder units: the supercooled water cylinder unit and the gas cylinder unit are used in the above-mentioned embodiment, it may be that only one supercooled water cylinder unit is used, and the supercooled water piston is moved in the supercooled water cylinder to mix the gas directly into the supercooled water inside the cylinder from outside the supercooled water cylinder unit. In this case, a heat exchanger may be provided in a gas inlet path to adjust the temperature of the gas to be mixed. Furthermore, although the coil type electric heater 13 is used in the above embodiments, another kind of a heater may be used. Depending upon a case, such a heater may be omitted.

In the above-embodiments, although the piston driver such as the electromagnetic solenoid is used to drive the piston, it may be that the piston is provided with a hand-operative member without any particular piston driver, and the piston is moved by hands.

What is claimed is:

1. A method for freezing supercooled water, comprising:

filling said supercooled water in a sealed container, mixing bubbles into the supercooled water comprising one of (i) reducing pressure of said supercooled water to generate bubbles from the supercooled water and mixing said generated bubbles in the supercooled water, (ii) providing a bubble-mixing inlet and reducing pressure of the supercooled water to mix bubbles into the supercooled water from outside of the container through the bubble mixing inlet, or (iii) providing a bubble-mixing inlet, introducing bubbles into the supercooled water from outside the container through the bubble-mixing inlet under pressure, and mixing the bubbles into the supercooled water;

simultaneously repeating expansion, compression, disruption, clustering and disappearance of the bubbles mixed into the supercooled water; and freezing the supercooled water by vigorously oscillating gas-liquid boundaries between the bubbles and the supercooled water.

2. An apparatus for producing frozen water from supercooled water, comprising:

a sealed container with a supercooled water inlet or a sealed container with a supercooled water inlet and a bubble-mixing inlet for sealingly filling said supercooled water therein;

a charger for filling the supercooled water into the sealed container; and a bubble mixer for mixing bubbles into the supercooled water filled in the sealed container by a step comprising one of (i) reducing pressure of said supercooled water inside the container to generate bubbles from the supercooled water and mixing said generated bubbles in the supercooled water, (ii) reducing pressure of the supercooled water filled in said container with the bubble-mixing inlet to mix bubbles into the supercooled water from outside of the container through the bubble mixing inlet, or (iii) introducing bubbles into the supercooled water filled in the container from outside the container through the bubble-mixing inlet under pressure to mix the bubbles into the supercooled water, wherein while the bubble mixer mixes the bubbles into the supercooled water, expansion, compression, disruption, clustering and disappearance of the bubbles are simultaneously repeated, and gas-liquid boundaries between the bubbles and the supercooled water are vigorously oscillated to produce the frozen water from the supercooled water.

3. The apparatus set forth in claim 2, wherein said sealed supercooled water container is a supercooled water cylinder, said supercooled water charger is a supercooled water piston gas-tightly, liquid-tightly and slidably fitted into the supercooled water cylinder, said supercooled water piston also serves as the bubble mixer, and the bubbles are mixed into the supercooled water inside the sealed supercooled water container by reducing pressure of the supercooled water through operating the supercooled water piston.

4. The apparatus set forth in claim 2, wherein said bubble mixer comprises a gas cylinder and a gas piston gas-tightly and slidably fitted into said gas cylinder, the gas cylinder and the sealed supercooled water container are connected to each other through the bubble-mixing inlet, the bubbles are introduced into the supercooled water in said container under pressure through the bubble-mixing inlet by operating the gas piston.

5. A method for circulating or flowing supercooled water, comprising:

taking at least a part of circulating or flowing supercooled water into a sealed container with a supercooled water inlet, mixing bubbles into the supercooled water in the sealed container comprising one of (i) reducing pressure of said supercooled water filled in the container to generate bubbles from the supercooled water and mixing said generated bubbles in the supercooled water, (ii) providing the supercooled water inlet with a bubble-mixing inlet reducing pressure of the supercooled water filled in the container to mix bubbles into the supercooled water from outside of the container through the bubble mixing inlet, or (iii) providing the supercooled water inlet with a bubble-mixing inlet and introducing bubbles from outside the container through the bubble-mixing inlet under pressure to mix the bubbles into the supercooled water;

simultaneously repeating expansion, compression, disruption, clustering and disappearance of the bubbles mixed into the supercooled water;

freezing the supercooled water by vigorously oscillating gas-liquid boundaries between the bubbles and the supercooled water; and returning the supercooled water at least a part of which is released from being supercooled into the circulating or flowing supercooled water.

6. A supercooled water-circulating or flowing system, comprising:

means for circulating or flowing supercooled water;

a sealed container provided with a supercooled water inlet or a sealed container provided with a supercooled water inlet and a bubble-mixing inlet, said container being adapted for sealingly receiving the supercooled water;

a charger for filling at least a part of the circulating or flowing supercooled water into the sealed container; and a bubble mixer for mixing bubbles into the supercooled water in the sealed container by a step comprising one of (i) reducing pressure of said supercooled water filled in the container to generate bubbles from the supercooled water, and mixing said generated bubbles in the supercooled water, (ii) reducing pressure of the supercooled water filled in the container to mix bubbles into the supercooled water from outside of the container through the bubble-mixing inlet, or (iii) introducing bubbles into the supercooled water filled in the container from outside the container through the bubble-mixing inlet under pressure to mix the bubbles into the supercooled water, wherein while the bubble mixer mixes the bubbles into the supercooled water, expansion, compression, disruption, clustering and disappearance of the bubbles are simultaneously repeated, gas-liquid boundaries between the bubbles and the supercooled water are vigorously oscillated to produce frozen water from the supercooled water, and a part of the frozen supercooled water is returned to the circulating or flowing supercooled water.

7. The supercooled water-circulating or -flowing system set forth in claim 6, wherein said supercooled water-sealing container is a supercooled water cylinder, said supercooled water charger is a supercooled water piston gas-tightly, liquid-tightly and slidably fitted into the supercooled water cylinder, said supercooled water piston also serves as the bubble mixer, and the bubbles are mixed into the supercooled water inside the supercooled water-sealing container through said bubble-mixing inlet by reducing pressure of the supercooled water through operating the supercooled water piston.

8. The supercooled water-circulating or -flowing system set forth in claim 6, wherein said bubble mixer comprises a gas cylinder and a gas piston gas-tightly and slidably fitted into said gas cylinder, the gas cylinder and the supercooled water-sealing container are connected to each other, and the bubbles are introduced into the supercooled water in said container under pressure by operating the gas piston.

9. The apparatus set forth in claim 3, wherein said bubble mixer comprises a gas cylinder and a gas piston gas-tightly and slidably fitted into said gas cylinder, the gas cylinder and the sealed supercooled water container are connected to each other through the bubble-mixing inlet, the bubbles are introduced into the supercooled water in said container under pressure through the bubble-mixing inlet by operating the gas piston.

10. The supercooled water-circulating or -flowing system set forth in claim 7, wherein said bubble mixer comprises a gas cylinder and a gas piston gas-tightly and slidably fitted into said gas cylinder, the gas cylinder and the supercooled water-sealing container are connected to each other, and the bubbles are introduced into the supercooled water in said container under pressure by operating the gas piston.

* * * * *